US007980249B2

(12) United States Patent
Landi et al.

(10) Patent No.: US 7,980,249 B2
(45) Date of Patent: Jul. 19, 2011

(54) ATHLETIC MOUTHGUARD WITH CUSTOMIZABLE COLOR INSERT

(75) Inventors: James Landi, West Orange, NJ (US); Michael Landi, Glen Ridge, NJ (US)

(73) Assignee: XO Athletic, Co., Union, NJ (US)

( * ) Notice: Subject to any disclaimer, the term of this patent is extended or adjusted under 35 U.S.C. 154(b) by 140 days.

(21) Appl. No.: 12/240,927

(22) Filed: Sep. 29, 2008

(65) Prior Publication Data

US 2009/0114232 A1 May 7, 2009

Related U.S. Application Data

(60) Provisional application No. 60/976,175, filed on Sep. 28, 2007.

(51) Int. Cl.
*A61C 5/14* (2006.01)
*A61C 3/00* (2006.01)

(52) U.S. Cl. ..... 128/859; 433/6

(58) Field of Classification Search ..... 128/859–862, 128/846, 848; 433/6

See application file for complete search history.

(56) References Cited

U.S. PATENT DOCUMENTS 6,494,210 B1 * 12/2002 Mams ..... 128/859
6,886,567 B1 * 5/2005 Liu ..... 128/861
2004/0076219 A1 * 4/2004 Madison et al. ..... 374/159

OTHER PUBLICATIONS http://www.shockdoctor.com/product/gel-max-lip-guard.aspx, (1999).

International Search Report, PCT/US08/78200, dated Nov. 28, 2008.

* cited by examiner

*Primary Examiner* — Patricia M Bianco
*Assistant Examiner* — Tarla R Patel
(74) *Attorney, Agent, or Firm* — Lerner, David, Littenberg, Krumholz & Mentlik, LLP

(57) ABSTRACT

This invention relates to a protective mouthguard for use by athletes that incorporates a color customizable feature, allowing users to customize the visible color of the mouthguard. The invented protective mouthguard has a u-shaped base that will fit inside of a user's mouth. The front surface of the mouthguard can be visible when the mouthguard is worn by the user inside of his mouth. A colorable strip is placed inside a cavity in the front wall of the mouthguard and is visible through holes that are placed in the front wall.

24 Claims, 15 Drawing Sheets

ATHLETIC MOUTHGUARD WITH CUSTOMIZABLE COLOR INSERT

CROSS REFERENCES TO RELATED APPLICATIONS

This application claims priority to provisional application No. 60/976,175 filed on Sep. 28, 2007, the entire disclosure of which is hereby incorporated by reference.

TECHNICAL FIELD

This invention relates to a protective mouthguard for use by athletes that incorporates a color customizable feature, allowing users to customize the visible color of the mouthguard.

BACKGROUND OF THE INVENTION

Existing mouthguards are generally horseshoe or U-shaped, with inner and outer walls that form a trough or channel for the upper or lower teeth. The mouthguards are typically made of a type of resin, usually a thermoplastic that softens in boiling water allowing the user to customize the mouthguard to fit the user's mouth, while still maintaining shock absorbing properties. The mouthguards are generally produced using an injection molding process, during which the resin is injected at high pressure into a mold, which is the inverse of the product's shape. The mold is typically made from metal and precision-machined to form the features of the desired part. In the molding process, the design of the mold must account for the ability to remove the molded product from the mold without damaging or distorting the molded product.

As many mouthguards are worn in team sports, it would be advantageous to have mouthguards that colored with the appropriate team colors. During the manufacturing process, a colorant, such as dye, can be added after the resin to produce different colors for the separate pieces that are injection molded.

This form of color customization has some major disadvantages with regards to the production and mass manufacturing of the product. Each time the colorant is added, the entire injection molding process is lengthened, which in turn increases production costs. In addition, because a different colorant has to be used if different colored pieces are desired, the process is further lengthened, and a continuous process cannot be maintained. Since the colorization of the mouthguard must be done during the manufacturing process, any commercial mass manufacturer must accurately predict the amount of mouthguard that will sell for each color and make the right amount for each. Such a prediction is not practical. Any pre-colored mouthguards that have the wrong team colors will not be bought by the users.

SUMMARY OF THE INVENTION

This invention solves the aforementioned problems by allowing the mouthguard user to color customize the mouthguard post-production and purchase. The mouthguard incorporates several different means in which a color piece or tab is secured to a designated area of the mouthguard, and is visible from the outside of the mouthguard.

In general, the invented mouthguard is U-shaped to fit the shape of the user's mouth, with optional inner and outer walls creating a trough for the user's teeth. The mouthguard is made of a type of thermoplastic that will soften when heated to allow the user to fit the mouthguard to his mouth. The mouthguard has locations in which a color tab can be inserted that will be visible when the user has the mouthguard in his mouth. The locations can be slots in the mouthguard that will hold the color tab securely with appropriately placed holes to reveal the colored tabs.

The use of the color tab/insert in the mouthguard provides an advantage over the use of coloration in the injection molding process. Because the color customization occurs after production of the mouthguard, the manufacturer can continuously produce one model per mold without any interruptions to the process. In addition, users of the mouthguard can switch the color tabs/inserts if they so choose, whereas the colorization during the injection molding process is permanent.

The mouthguard may also include an optional tether located and extending out from the bottom of the mouthguard. The tether may be composed of the same material as the mouthguard. The tether will have an area directly attached to the tray bottom that will tear at a predetermined pull force for a desired tear away feature. The area could be thinner material or have perforations to weaken the area. Other means of affecting the area to ensure that the area will break before any other section of the tether can be used and still be within the scope of the invention. The tether piece will then thicken as it extends outward toward the wearer's facemask. Behind the area where the tether is designed to breakaway is a hole in the mouthguard. The hole is oval in shape while the tether is cylindrical or vice versa. The difference will allow the tether to have a friction fit within the hole. Once the tether is torn away, this creates a blind or invisible hole that is revealed so the user can replace the tether with a friction type fit, round tongue to oval shaped hole.

The opposite side of the tether will feature a wrap around detail to attach to the users facemask found on most protective helmets. The wrap around detail involves a ratcheted system that will keep the tether loop created by looping the mouthpiece through the tether end opening and when pulled tight using the elastomer coefficient of friction characteristics and a mating mechanical ratcheted detail keeping the loop tightly wound around the user's facemask. The wrap around feature will have a pull away or break free force greater than that of the thin tear away area molded next to the tray bottom.

DETAILED DESCRIPTION

Figure 1:
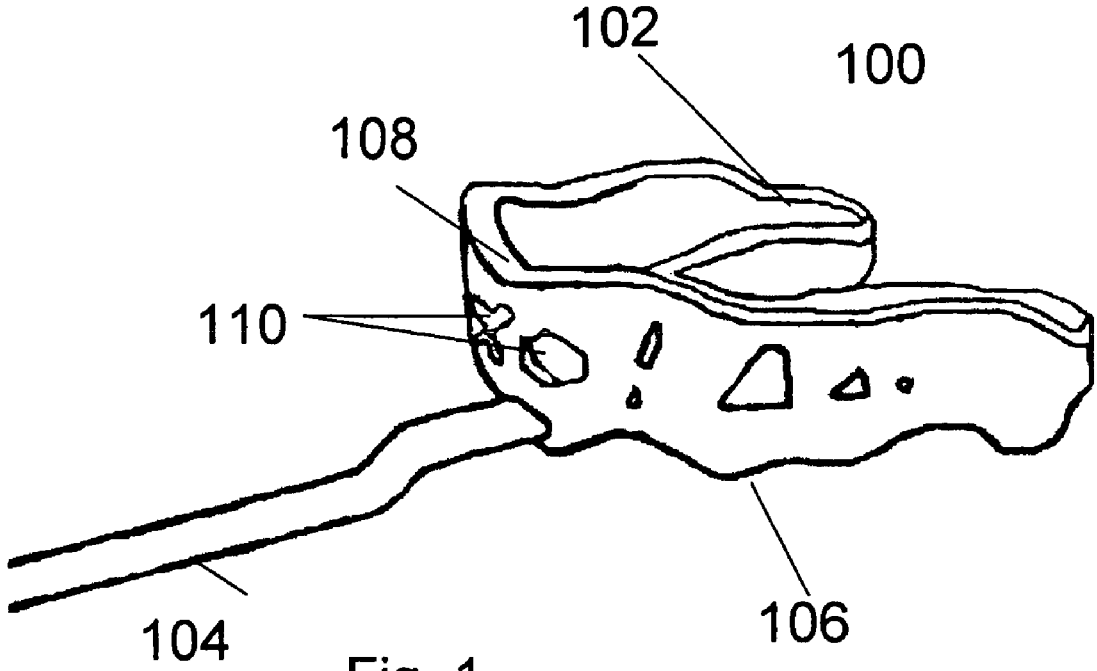
FIG. 1 shows a perspective view of the invented mouthguard in accordance with one embodiment of the invention.
Figure 2:
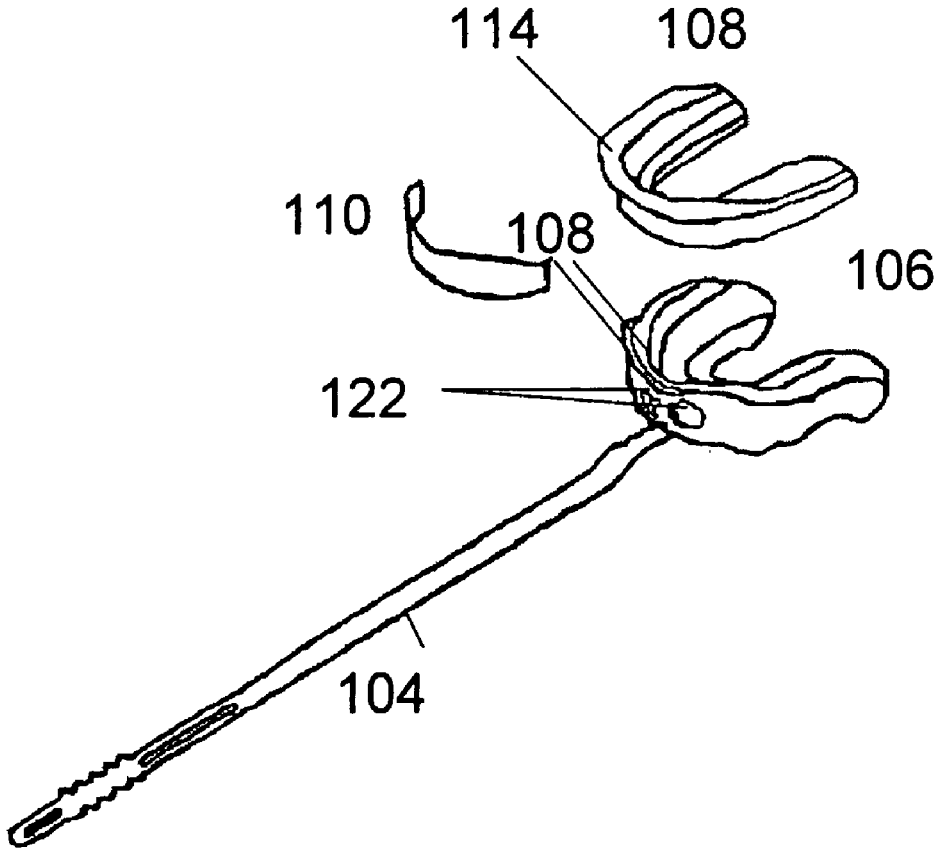
FIG. 2 shows a perspective view of the same embodiment with the components separated from each other.
Figure 3:
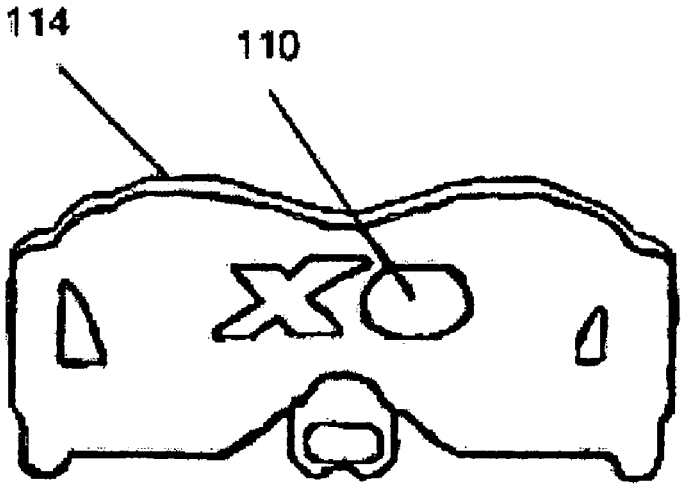
FIG. 3 shows a front view of the same embodiment with the customizable color insert in the mouthguard.
Figure 4:
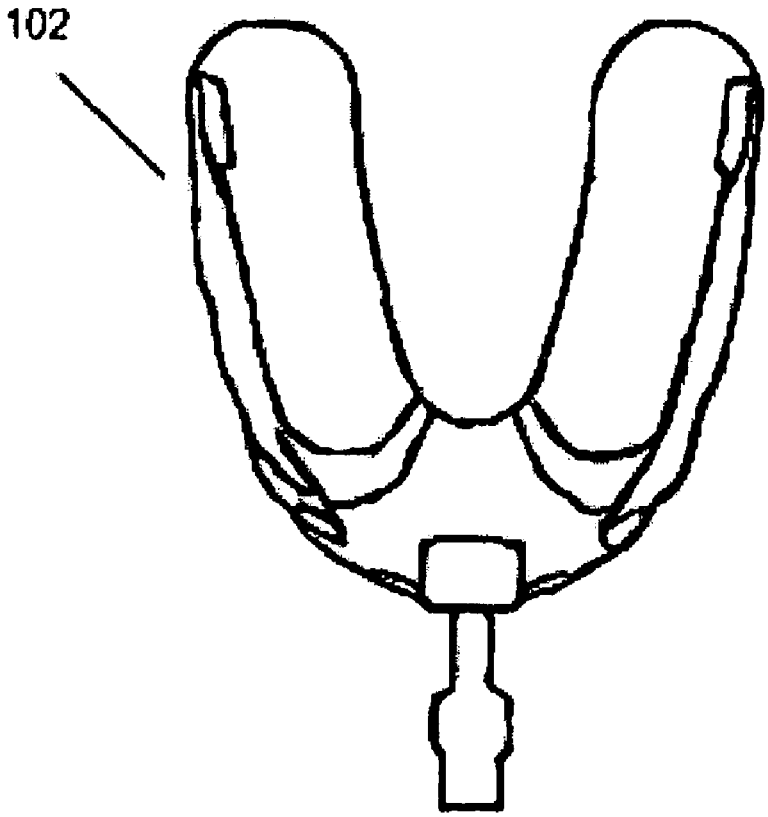
FIG. 4 shows a bottom view of the same embodiment.
Figure 5:
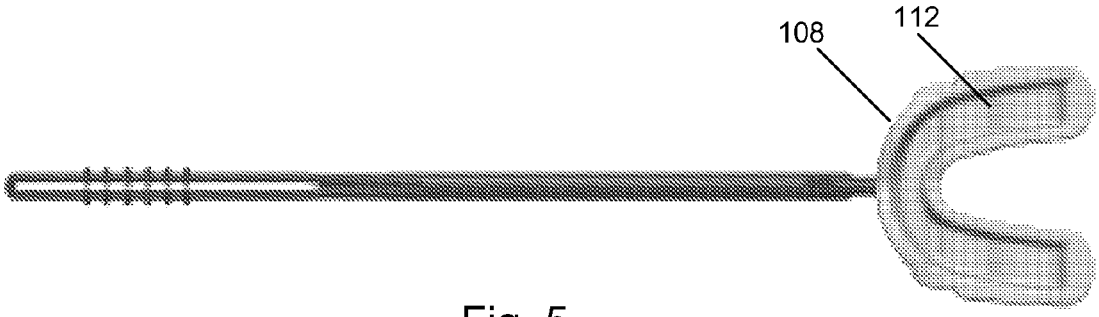
FIG. 5 shows a top view of the same embodiment.
Figure 6:
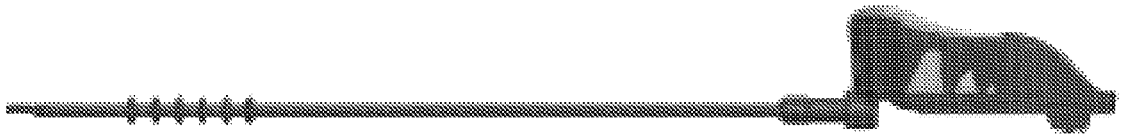
FIG. 6 shows a side view of the same embodiment.

For the purposes of understanding the invention, reference will now be made to the embodiments illustrated in the drawings. It will be understood that no limitation of the scope of the invention is thereby intended. Any alterations and further modifications in the described embodiments, and any further applications of the principles of the invention as described herein are contemplated as would normally occur to one skilled in the art to which the invention relates.

FIGS. 1-8 depict one embodiment of the invention. The invented mouthguard 100 is composed of a base unit 102 and tether 104. The base unit 102 is U-shaped to conform to a user's mouth and the tether 104 extends from the front of the mouthguard. On the top surface, base unit 102 has a trough 112 running along the inside of the U-shape to fit the user's upper teeth. In this embodiment, base unit 102 is comprised of three different portions: (1) a bottom tray 106, (2) a top piece 108 and (3) a color insert 110.

The three components of the base unit are configured to fit together. The bottom tray 106 is U-shaped and will be sized to fit into the user's mouth. The bottom tray 106 has a double outer wall 116 (composed of inner wall 124 and outer wall 118) that can extend along the front of the mouthguard. If desirable, the double wall 116 can extend along the entire outside labial perimeter of the mouthguard, continuously or in sections. The inner and outer walls 124, 118 are placed closed together so that a thin space or slot exists between the two in which the color insert 110 can be placed. The outer wall 118 of the double wall 116 has holes 122 that reveal the color insert 110 when it is placed in the slot 120. The holes in this embodiment are in the shape of an "X" and an "O", though the invention is not limited to these shapes.

Figure 7:
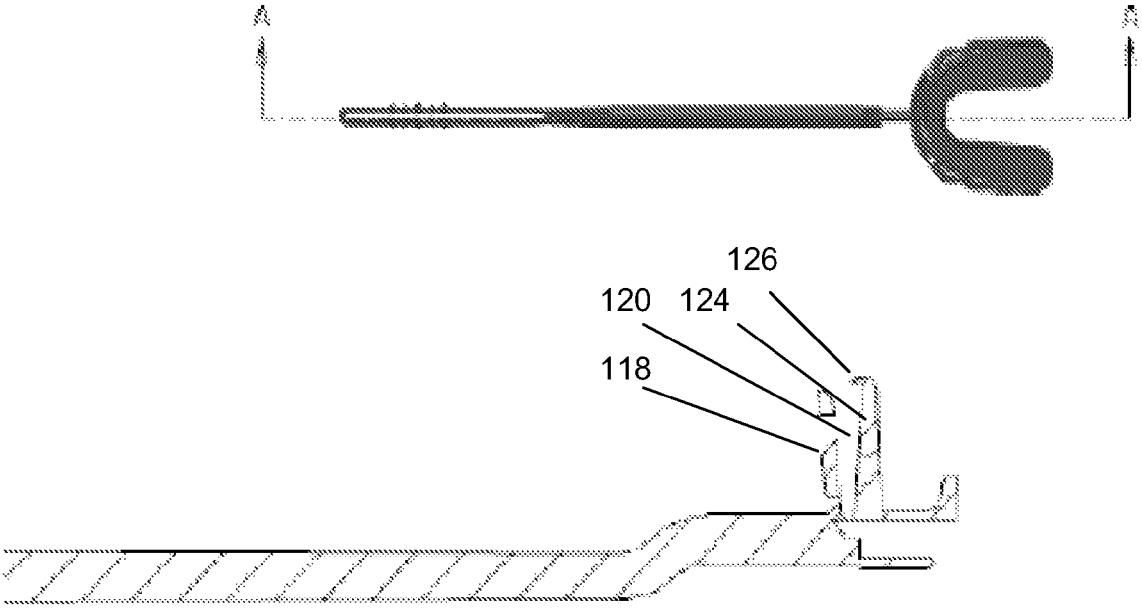
FIG. 7 shows a cross-sectional view of the bottom tray of the mouthguard of FIG. 1 along the lines A-A.

Inner wall of the double wall has a "trap door" that encloses the slot to ensure that the color insert 110 is firmly set within the slot 120. The trap door can be seen in detail in FIG. 7. FIG. 7 is a cut-away depiction of the bottom tray 106 along lines A-A. As can be seen, outer wall 118 is a straight wall with holes 122 in it. Inner wall 124 has a lip 126 that projects toward outer wall 118. Once the color strip is placed in the slot between the inner and outer walls, the projecting lip 126 will prevent the color insert from coming out of the slot. The location of projecting lip 126 is shown on inner wall, but it could easily be located on outer wall.

Top piece 108 is also in a U-shape to conform to the user's mouth. Top piece 108 can have the trough 112 on its upper surface and the bottom surface will conform to the upper surface of the bottom tray 106. Top piece 108 will also have a lip 114 that will come on top of the double wall 116. Lip 114 will help to seal the slot 120 and prevent color insert 110 from coming out of the slot 120.

Figure 9:
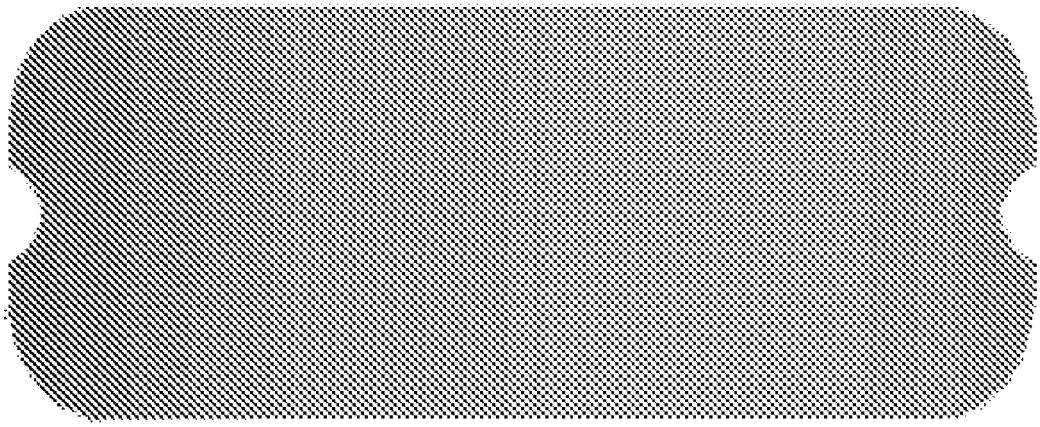
FIG. 9 shows a front view of the color insert.

A typical color tab/insert can be seen in FIG. 9. It is made of a firm yet malleable material, such as plastic or rubber, and can come in different forms, such as, but not limited to, stickers, decals, or just plain tabs. It can be of all various colors, but is not limited to a solid color as it may include patterns of different sorts as well. This provides an additional advantage over existing mouthguards. With the current molding process, it would be difficult, if not impossible, to incorporate elaborate patterns of any sort, let alone mass produce mouthguards with such patterns. For commercialization purposes, a multitude of different colored inserts can be inexpensively manufactured and packaged with a single mouthguard product.

Each component of base unit 102 can be easily manufactured using injection molding techniques. Other techniques, such as extrusion blow molding, injection blow molding, compression molding, thermal forming or cast pour molding process lost core molding can also be used. Bottom tray 106 can be composed of a relatively material that has some durability and flexibility, such as a thermoplastic elastomer (TPE). Bottom tray 106 will be molded first. Double wall 116, slot 120, holes 122 and lip 126 are all moldable features and mouthguard bottom tray 106 is easily removed from the mold. Bottom tray 106 will be capable of accepting a second shot of a softer, pliable material, such as ethylene vinyl acetate ("EVA"), on top of it to create top piece 108 during the injection molding process. In this process, the top piece will conform to the shape of the bottom tray 106 and the lip 114 can be shaped to cover both inner and outer walls 118, 124 of the bottom tray 106. Color insert 110 can be easily manufactured in numerous colors and colored patterns to be included with the base unit 102. It will be evident to one of skill in the art that any appropriate materials can be used for both the top and bottom pieces.

To custom color the mouthguard, the user will choose the appropriately colored color insert 110 that corresponds to the team colors. In order to add the color insert 110, the user must pull up the outer lip 114 of the top piece 108 and slide the insert into the slot 120. The lip 114 will naturally return back to its original shape and cover both the tops of the inner and outer walls. Alternatively, the color strip can be placed into the slot 120 through appropriate openings in the side or bottom of the mouthguard.

After inserting the color insert 110, the user will custom fit the mouthguard by boiling the mouthguard in water. This boiling process will soften the top piece 108. Afterwards, the mouthguard is placed in the user's mouth and the user will bite down onto the mouthguard to conform the mouthguard to the teeth. After the mouthguard has cooled, the top piece 108 will be cured and fitted to the user's teeth. In addition, the top piece 108 will be forced against the double wall 116 and on top of the double wall 116 to seal the slot closed.

Figure 8:
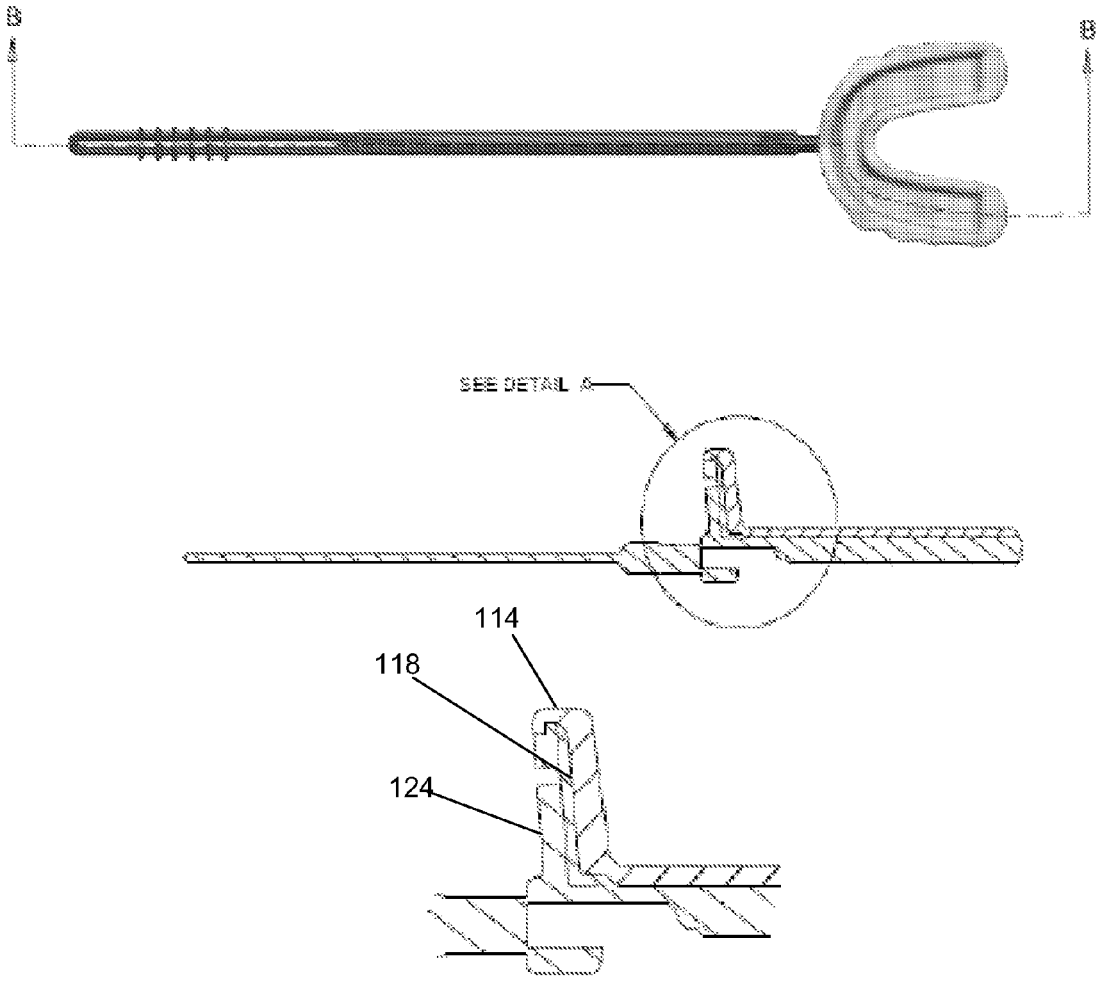
FIG. 8 shows a cross-sectional view of the mouthguard of FIG. 1 along the lines B-B.

The configuration of the top piece 108 and the double wall 116 is best seen in FIG. 8. FIG. 8 shows a cross-sectional view of the two components along line B-B. As can be seen in the detailed figure, the inner wall 124 and outer wall 118 are pressed against one another. This occurs, in part, from the pressure from the user biting down on the mouthguard during the customization process and the resilience of the top piece 108 after being cured through the boil and bite process.

Figure 10:
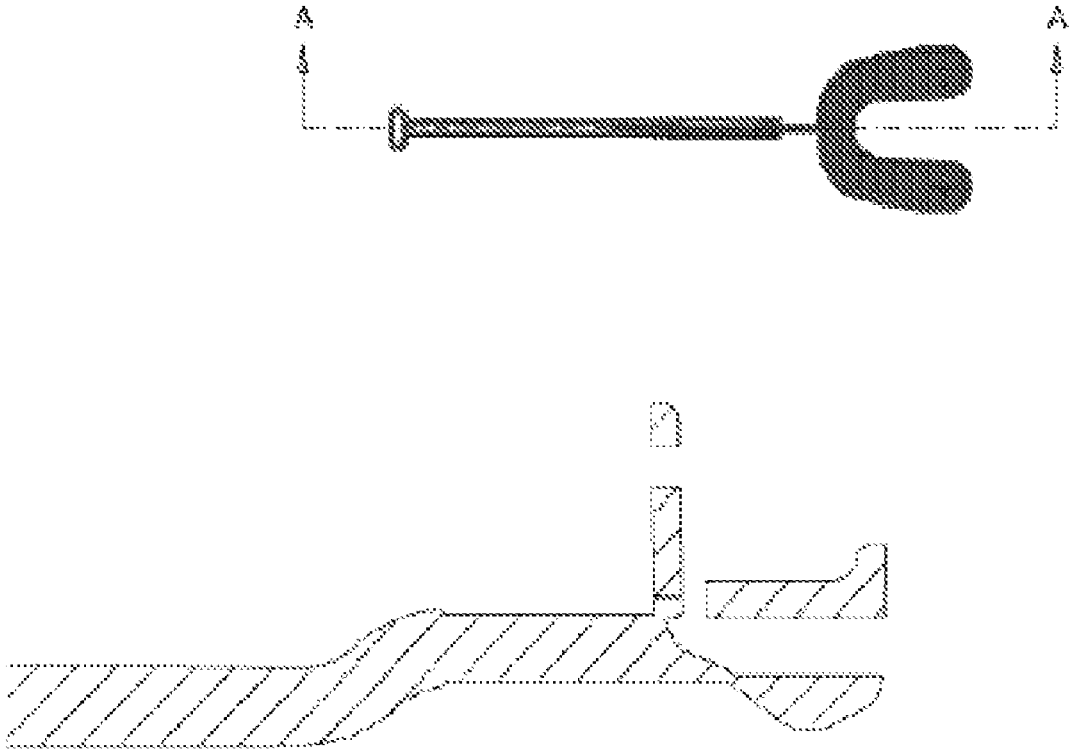
FIG. 10 shows a cross-sectional view of the invented mouthguard in accordance with another embodiment of the mouthguard.
Figure 11:
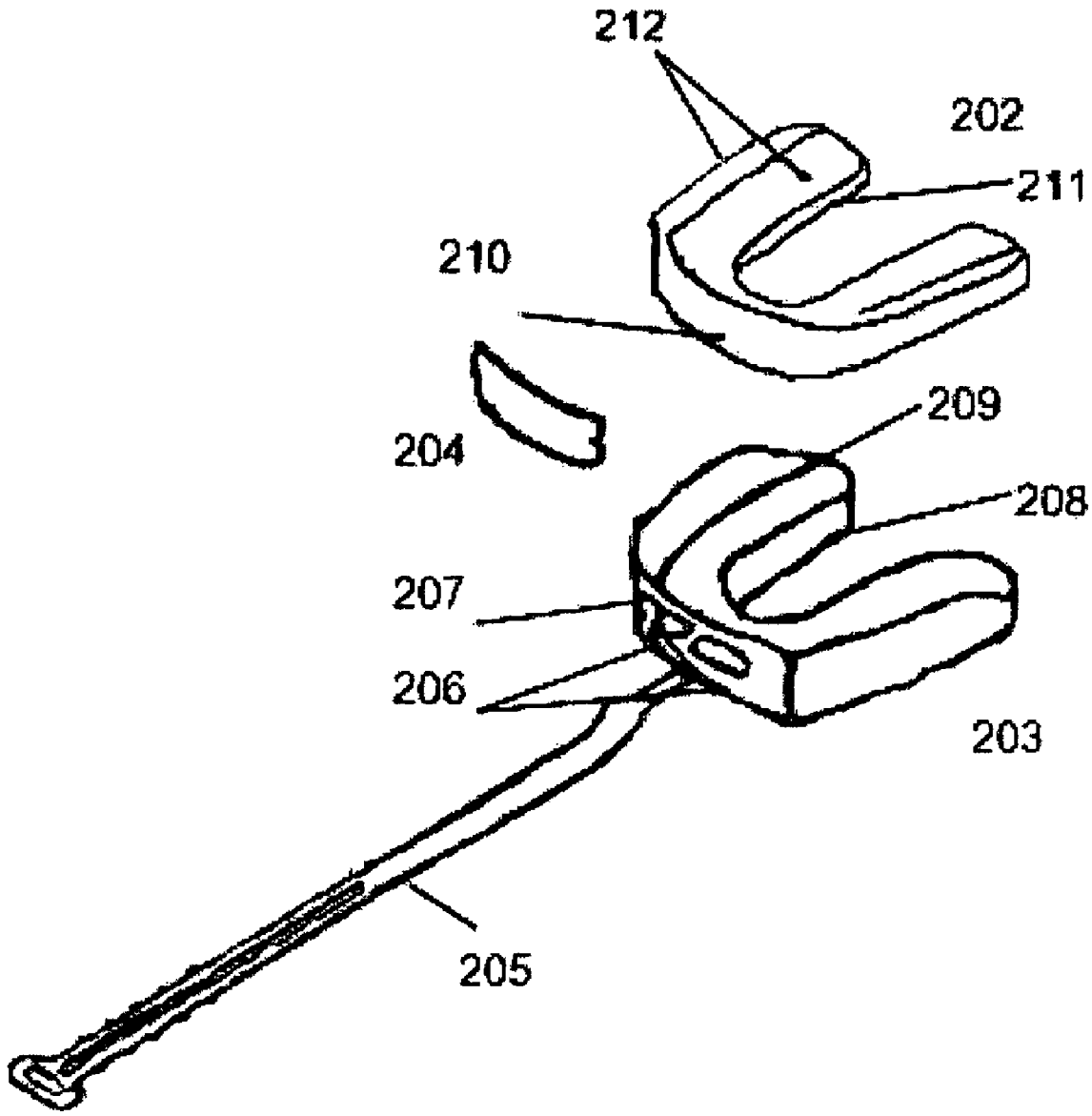
FIG. 11 shows a perspective view of another embodiment with the components separated from each other.

FIGS. 10-11 depict another embodiment that is a similar to the embodiment described above. Similar to that embodiment, the mouthguard base unit 201 comprises a top piece 202, a bottom tray 203 and color insert 204. The bottom tray 203 has a single outer wall 207 instead of a double wall. Single outer wall 207 has holes or revealed sections 206 in the front. Top piece 202 has an indented section 210 in the front of it to accommodate the color insert 204. Color insert 204 will be placed in between the single outer wall 207 of bottom tray 203 and indented section 210 of the top piece 202. During the customization process in which the mouthguard is boiled and custom fitted to the user's teeth, the color insert will be secured in between the top piece and the bottom tray.

Figure 12:
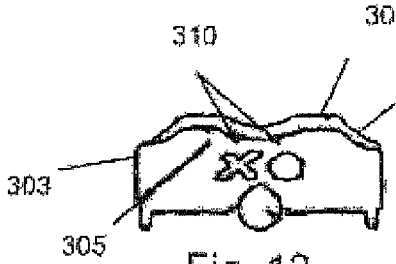
FIG. 12 shows a front view of yet another embodiment.
Figure 13:
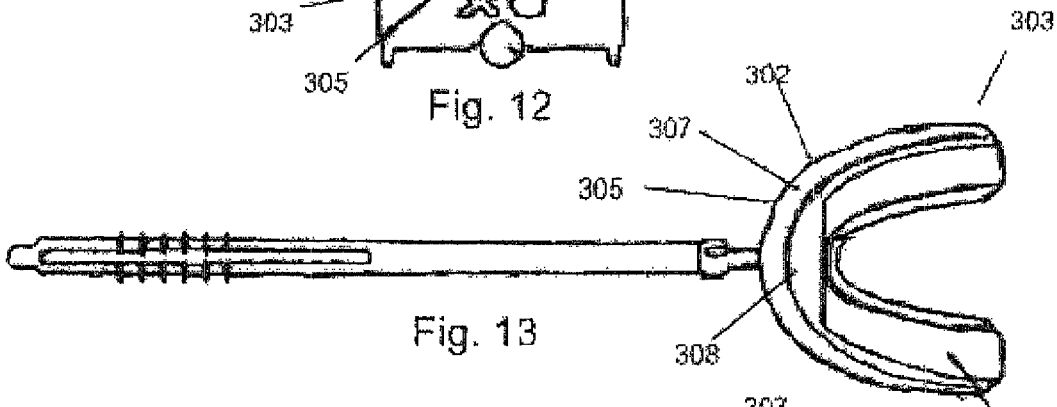
FIG. 13 shows a top view of the same embodiment.
Figure 14:
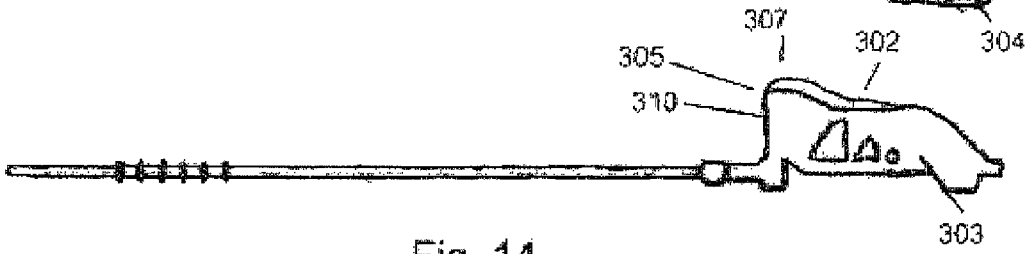
FIG. 14 shows a side view of the same embodiment.

FIGS. 12-14 depict another embodiment in which the top piece 302 does not completely overlay the bottom piece 303. The top piece 302 only has an outer wall that ends in a lip 307. Only the front teeth come into contact with the top piece 302 at a bite portion 308. The back teeth come into contact with the trough 304 of the bottom piece 303. The bottom piece still has the holes 310 in the front of its outer wall 305. The color insert can be seen through these holes 310, as shown in FIG. 12.

Figure 15:
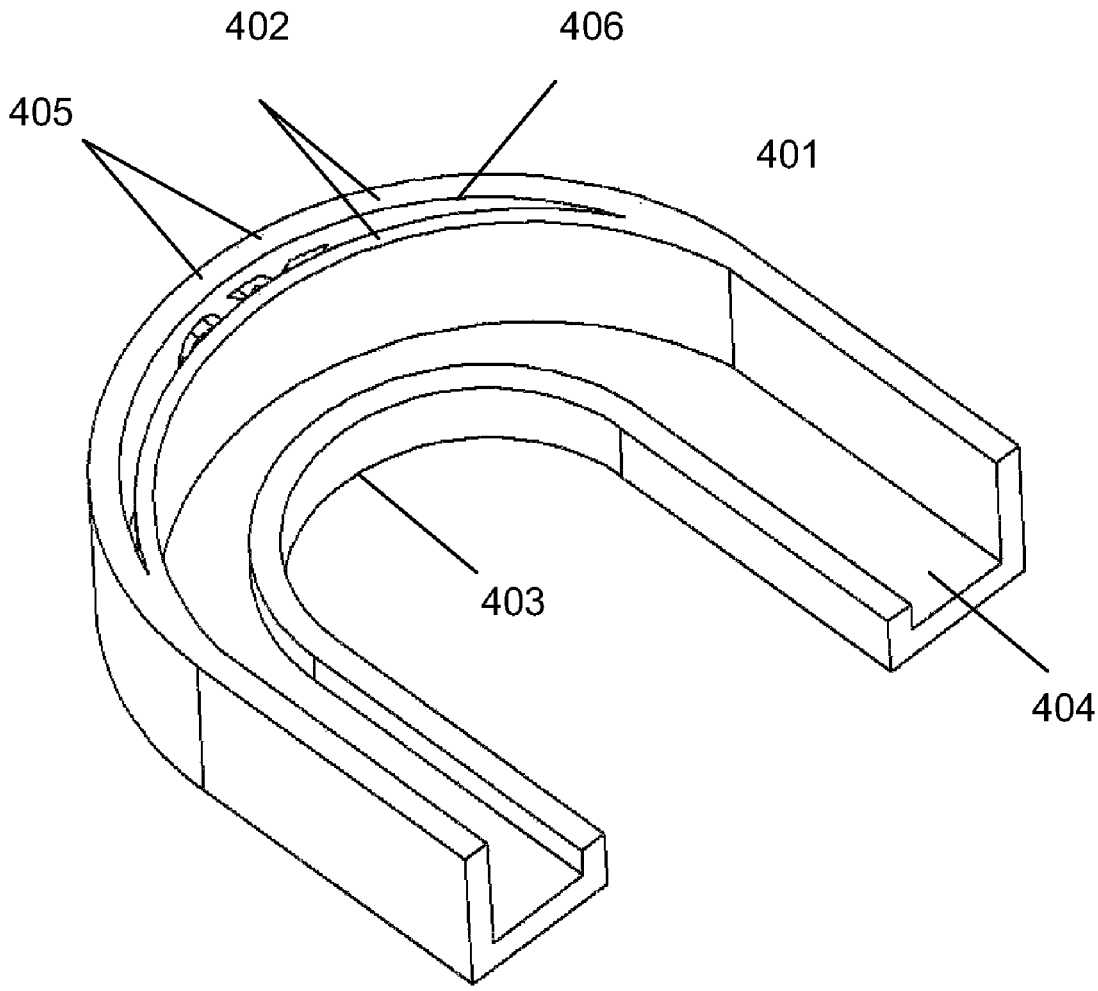
FIG. 15 shows a perspective view of yet another embodiment.

FIG. 15 depicts another embodiment. Unlike the embodiments described above, this embodiment is made of only one piece. Similar to the bottom piece of the first embodiment, this mouthguard 401 has a double outer wall 402 and an inner wall 403 that form a trough 404 for the user's teeth. The double wall 402 creates a slot 406 in which the color insert will fit. The outermost wall of the double wall 402 contains the holes 405, and the color insert will be visible through these holes.

Figure 16:
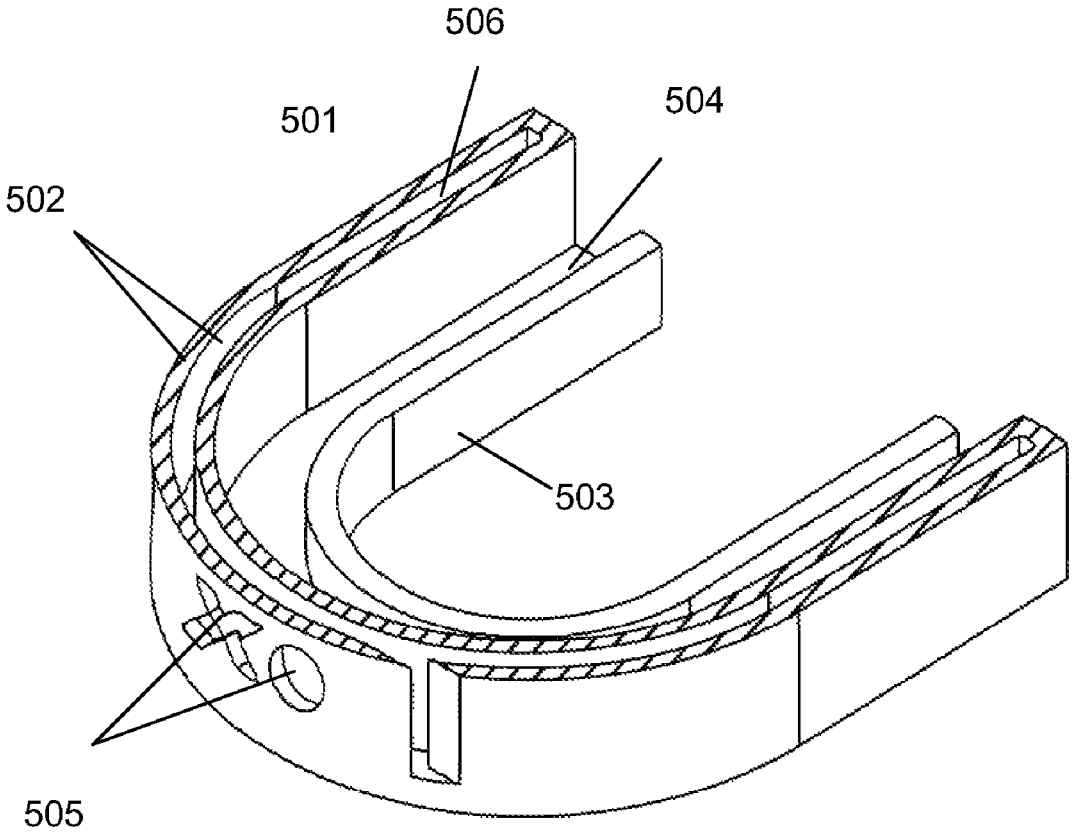
FIG. 16 shows a perspective view of yet another embodiment.

FIG. 16 depicts another embodiment that is similar to the previously described embodiment. In this embodiment, the slot 506 created by the double wall 502 extends all the way to the rear of the mouthguard 501. This allows the option of adding holes all along the outer wall, in addition to the holes 505 in the front, and using a longer color insert to sit in the slot. The insert will then be visible through these additional holes all along the outer wall.

Figure 17:
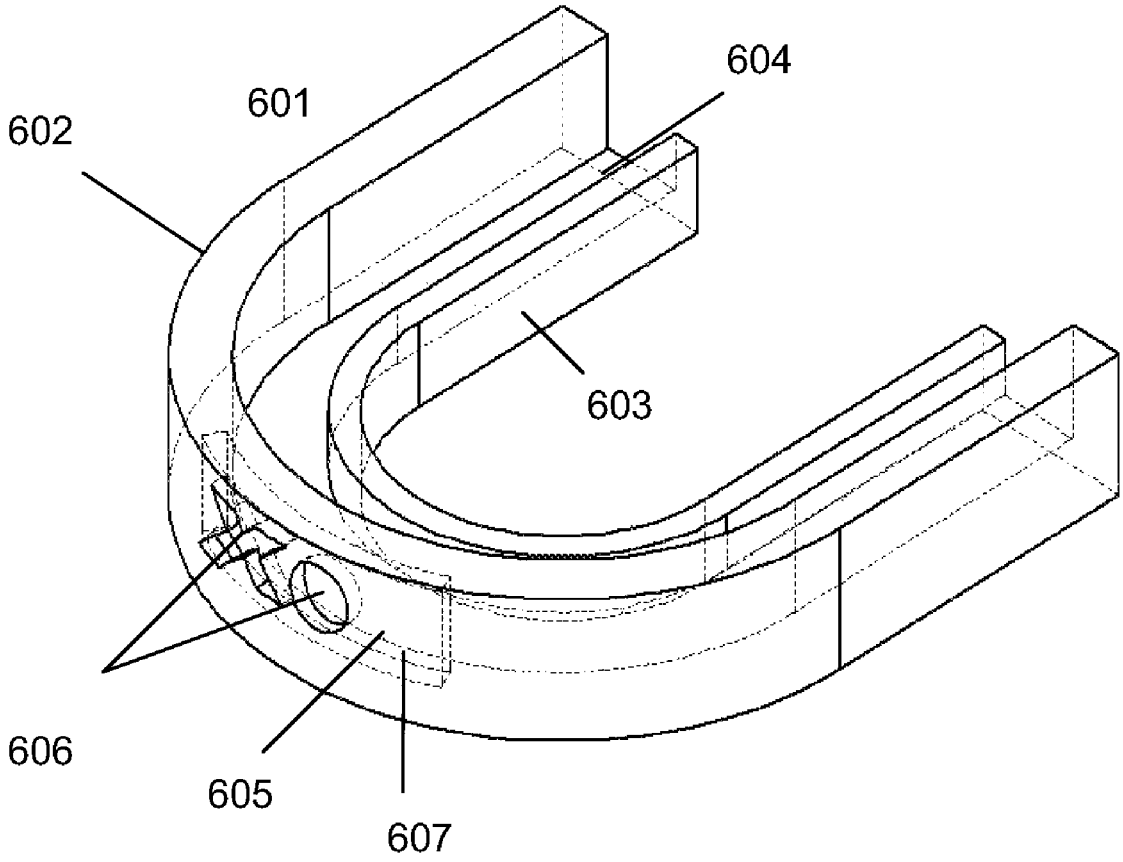
FIG. 17 shows a perspective view of yet another embodiment.

FIG. 17 depicts yet another embodiment that comprises just one piece 601. It has an outer wall 602 and an inner wall 603, forming a trough 604 for the user's teeth. In the outer wall 602, there is a removable section 605 that contains the holes 606. This creates a recess or compartment 607 within the front wall of the mouthguard in which the color insert is to be placed. After the color insert is placed in the recess, the removable section is fit back into the recess, thereby firmly securing the color insert.

Figure 18:
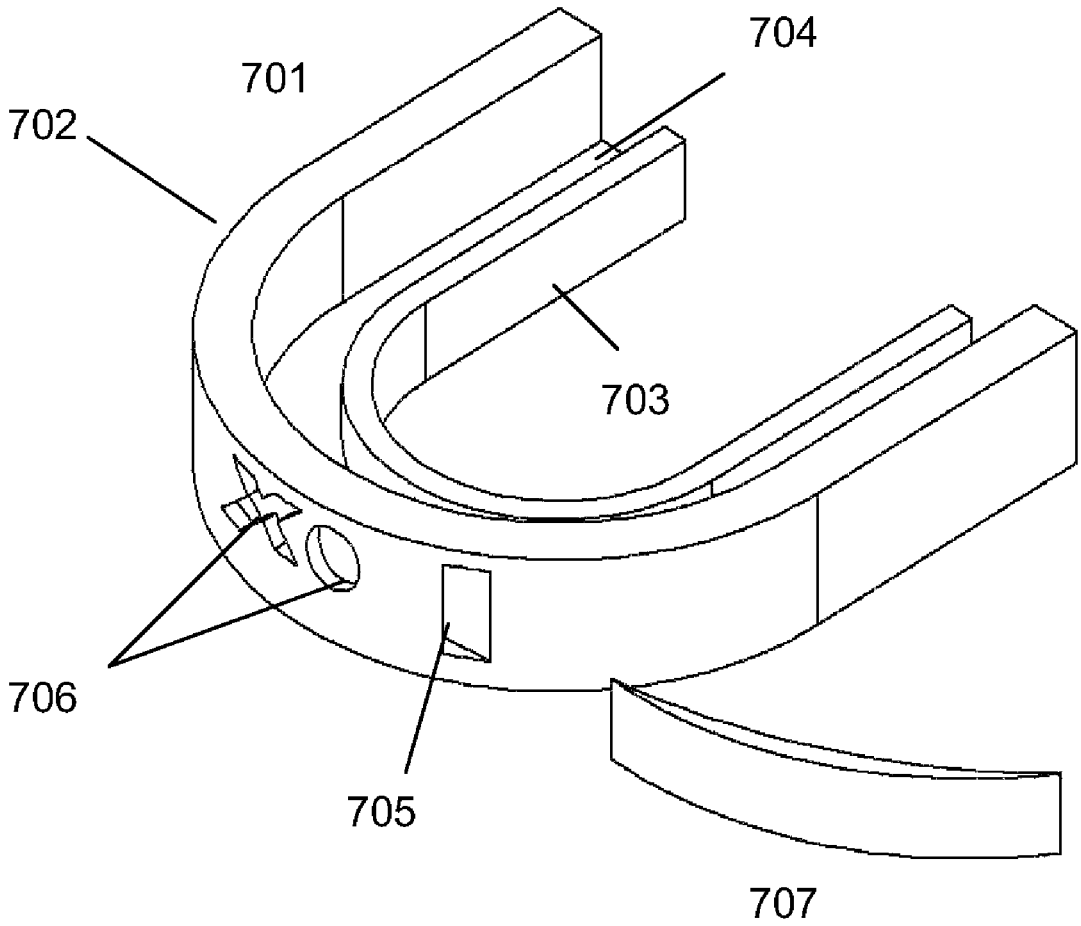
FIG. 18 shows a perspective view of yet another embodiment.

FIG. 18 depicts yet another embodiment that is made of only one piece 701. The outer wall 702 has a slot 705 cut out in which the color insert 707 is inserted in from the side. The front of the outer wall 702 has holes 706 that penetrate to the back wall of the slot 705. Once the color insert 707 is inserted into the slot 705, the color will be clearly visible.

Figure 19:
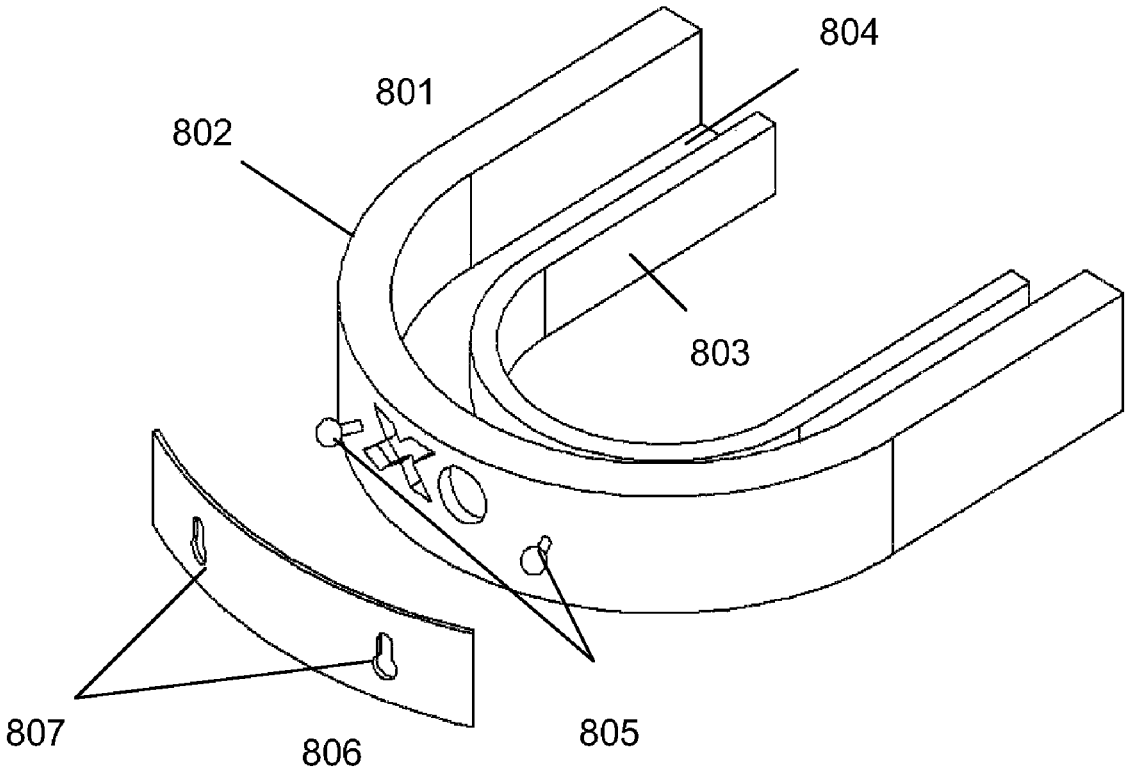
FIG. 19 shows a perspective view of yet another embodiment.
Figure 20:
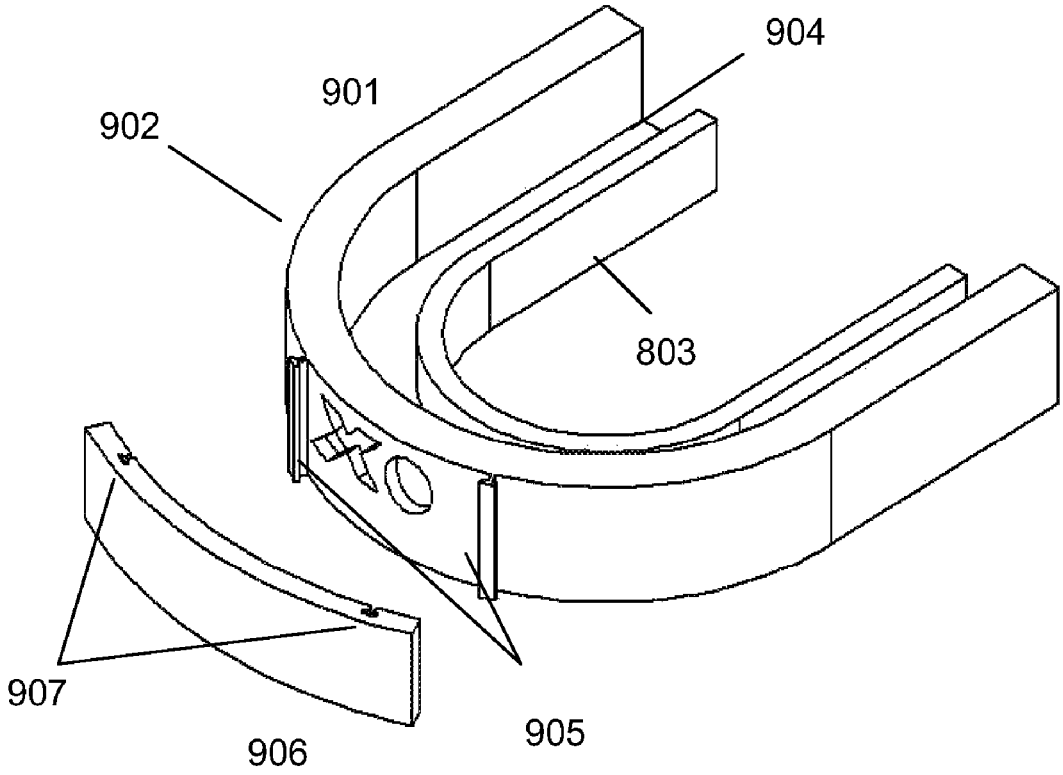
FIG. 20 shows a perspective view of yet another embodiment

Another means in which this invention can realize the advantage of mass production and easier customization by the user is to generally have a color strip attached to the outer surface of the labial wall of the mouthguard. This can be accomplished in a number of ways. Two such ways are depicted in FIGS. 19 and 20. Again, like the embodiments described above, these two embodiments are made of only one piece. However, on the outer surface of the outer wall are protrusions 805 and 905, respectively, on which the color tabs will be attached. These protrusions take the shapes of knobs 805 and Ts 905, respectively. With respect to the knobs 805, the color tab 806 will have holes 807 to fit around the knobs, and that are spaced appropriately apart to allow the tab 806 to fit tightly against the face of the outer wall 802. The Ts 905 of the other embodiment perform a similar function of securing the color tab 906 to the body 901. The color tab 906 will likely have to be of greater thickness than the tabs/inserts of the previous embodiments so that it may include the sister connections 907 to the T-shaped protrusions 905. Another means to accomplish this may be done by using a decal or sticker to stick to the front of the labial wall of the mouthguard, thereby eliminating the need for protrusions on the outer wall.

The present invention may be embodied in other specific forms without departing from the spirit or general characteristics thereof; therefore, the embodiments described herein are to be considered in all respects illustrative and not restrictive. The scope of the invention is to be indicated by the appended claims, rather than by the foregoing description.

We claim:

1. A protective mouthguard comprising:

a u-shaped body capable of being placed in a user's mouth, said u-shaped body having an anterior portion dimensioned to receive the user's teeth, said anterior portion including an inner wall and a visible outer wall having an opening, the visible outer wall being located on the front of said anterior portion, said inner wall being spaced apart from the visible outer wall forming a space therebetween; and an insertable tab of at least one different color than said visible outer wall, wherein said insertable tab is shaped to be received within said u-shaped body in the space between the visible outer wall and the inner wall such that said insertable tab is visible through said opening when said visible wall is seen.

2. The protective mouthguard as recited in claim 1, wherein said opening comprises a plurality of holes in the visible wall and said insertable tab is visible through said holes.

3. The protective mouthguard as recited in claim 2 wherein said holes have a predetermined shape.

4. The protective mouthguard as recited in claim 1, wherein said u-shaped body comprises an accessible slot in said visible wall, said slot being sized to hold said insertable tab.

5. The protective mouthguard as recited in claim 4, wherein said u-shaped body retains said insertable tab in said slot.

6. The protective mouthguard as recited in claim 4, further comprising a flexible body that is affixed on top of said u-shaped body; said flexible body being positioned to seal said slot to retain said insertable tab.

7. The protective mouthguard as recited in claim 6, wherein said flexible body extends on top of said u-shaped body.

8. The protective mouthguard as recited in claim 4 wherein said slot is accessible through a hole in said visible wall.

9. The protective mouthguard as recited in claim 4 wherein said slot is accessible through the top of said visible wall.

10. The protective mouthguard as recited in claim 1, wherein said insertable tab contains a decorative pattern.

11. The protective mouthguard as recited in claim 1, further comprising an access aperture on a side of the anterior portion of the u-shaped body, said access aperture being dimensioned to receive the insertable tab and leading to the space between the visible outer wall and the inner wall.

12. A mouthguard, comprising a base unit formed in a shape to conform to a user's mouth, said base unit comprising an anterior portion dimensioned to receive the user's teeth, the anterior portion comprising an inner wall and an outer wall that is capable of being visible when said mouthguard is placed in the user's mouth, the inner wall being separated from the outer wall forming a space therebetween; and a colored insertable tab appended to said outer wall and disposed within the space between the inner wall and the outer wall such that said insertable tab is visible through an opening within said outer wall.

13. The mouthguard as recited in claim 12 wherein said space comprises a slot that is capable of receiving and retaining said colored insertable tab in said slot.

14. The mouthguard as recited in claim 13 wherein said slot is located inside said outer wall within said space.

15. The mouthguard as recited in claim 13 wherein said slot is capable of receiving said colored insertable tab through an accessible slot in the top of said outer wall.

16. The mouthguard as recited in claim 13 wherein said slot is capable of receiving said colored insertable tab through a hole in said outer wall.

17. The mouthguard as recited in claim 13 wherein said slot is capable of being closed to retain said colored insertable tab inside said slot.

18. The mouthguard as recited in claim 12 wherein said opening comprises a plurality of holes and said colored insertable tab is visible through said holes.

19. The mouthguard as recited in claim 12, further comprising an access aperture on a side of the anterior portion of the base unit, the access aperture being dimensioned to receive the colored insertable tab and leading to the space between the outer wall and the inner wall.

20. A mouthguard comprising:

a u-shaped base unit sized to fit in a user's mouth and comprising an anterior portion dimensioned to receive the user's teeth, said anterior portion having a back wall and a front wall, said front wall capable of being visible when said mouthguard is worn by said user, said front wall and back wall forming a slot therebetween, the front wall having at least one hole leading to the slot; and an insertable tab that is comprised of a different color than said front wall, said insertable tab being sized to fit inside said slot and wherein said insertable tab is visible through said at least one hole.

21. The mouthguard as recited in claim 20, further comprising an access aperture on a side of the anterior portion of the u-shaped base unit, the access aperture being dimensioned to receive the insertable tab and leading to the slot between the front wall and the back wall.

22. A mouth guard comprising:

a body having a first portion adapted to be placed in a user's mouth; said body having a second portion visible when said first portion is placed in a user's mouth, said second portion having an inner wall and an outer wall forming a space therebetween, said outer wall having at least one visible hole; and an insertable tab adapted to be received within said space whereby said tab is visible through said hole.

23. The mouth guard as recited in claim 22, wherein said tab has a color different than the color of said outer wall.

24. The mouth guard as recited in claim 22, further comprising an access aperture on a side of the second portion of the body, the access aperture being dimensioned to receive an insertable tab and leading to the space between the inner wall and the outer wall.

* * * * *